US012550996B2

(12) United States Patent
Moretti

(10) Patent No.: US 12,550,996 B2
(45) Date of Patent: Feb. 17, 2026

(54) CONTAINER FOR A COSMETIC PRODUCT

(71) Applicant: LUMSON S.p.A., Capergnanica (IT)

(72) Inventor: Matteo Moretti, Crema (IT)

(73) Assignee: LUMSON S.p.A., Capergnanica (IT)

( * ) Notice: Subject to any disclaimer, the term of this patent is extended or adjusted under 35 U.S.C. 154(b) by 47 days.

(21) Appl. No.: 18/524,084

(22) Filed: Nov. 30, 2023

(65) Prior Publication Data

US 2024/0180313 A1 Jun. 6, 2024

(30) Foreign Application Priority Data

Dec. 2, 2022 (IT) ..... 102022000024909

(51) Int. Cl.
*A45D 33/24* (2006.01)
*A45D 34/00* (2006.01)

(52) U.S. Cl.
CPC ..... *A45D 33/24* (2013.01); *A45D 34/00* (2013.01); *A45D 2034/005* (2013.01)

(58) Field of Classification Search
CPC ..... A45D 33/24; A45D 33/34; A45D 34/00; A45C 5/005; A45C 11/008; B65D 21/02; B65D 1/08; B65D 21/0233
USPC ..... 206/223, 581, 385; 220/23.83, 23.87
See application file for complete search history.

(56) References Cited

U.S. PATENT DOCUMENTS 5,709,311 A * 1/1998 Butler ..... B65D 51/223 220/255
7,669,725 B2 * 3/2010 Randolph ..... A61J 11/0065 220/23.91
2011/0056866 A1 * 3/2011 Thiebault ..... A45D 40/265 206/581
2012/0267388 A1 * 10/2012 Tom ..... B29C 49/04 222/105
2013/0105476 A1 * 5/2013 Hammer ..... B65D 21/0233 29/428
2014/0027329 A1 * 1/2014 Dasbach ..... A61M 5/002 206/366
2015/0230583 A1 * 8/2015 Maelstaf ..... B65D 25/108 29/451
2017/0265625 A1 * 9/2017 Thorpe ..... A45D 33/006
2022/0312935 A1 * 10/2022 Del Din ..... A45D 40/0068

FOREIGN PATENT DOCUMENTS

DE 20004211 U1 * 6/2000 ..... A45D 40/0068
KR 102270703 B1 6/2021
WO WO-2019058087 A1 * 3/2019 ..... A45D 33/003

* cited by examiner

*Primary Examiner* — Rafael A Ortiz
(74) *Attorney, Agent, or Firm* — Dickinson Wright PLLC; Andrew D. Dorisio

(57) ABSTRACT

A container for a cosmetic product includes a pot and a lid, there being mutual coupling means between the pot and the lid, and a vessel positioned at least partially inside the pot, the container being made of plastic material, the pot having, at a mouth thereof, at least one tooth protruding laterally with respect to the mouth, the vessel including a flange resting on a free end of the mouth of the container, there extending from the said flange, in an essentially perpendicular direction with respect thereto, at least one skirt which is equipped with at least one counter-tooth which engages, in an undercut manner, with the said at least one tooth, the skirt being interrupted in at least one portion along the perimeter in order to expose at least part of the flange.

5 Claims, 3 Drawing Sheets

CONTAINER FOR A COSMETIC PRODUCT

This application claims priority to Italian Patent Application for Invention No. 102022000024909 filed on Dec. 2, 2022, the disclosure of which is incorporated herein by reference.

FIELD OF THE INVENTION

The present invention relates to a container for a cosmetic product.

In particular, it refers to a container for a cosmetic product such as a cream, a powder (e.g. face powder), and the like, including medical products.

BACKGROUND ART

There are various types of containers according to prior art which are formed of a pot inside which there is a plastic vessel envisaged which is fastened firmly to the mouth of the pot and which holds a cosmetic substance.

The pot normally features a thread for coupling with a cap which allows the container to be hermetically sealed when not in use.

The pots according to prior art are not environmentally friendly since it is impossible (or very difficult) to separate the internal vessel from the pot. If the pot is made of glass, this is a considerable problem as it is impossible to correctly dispose of the container among sorted waste.

Furthermore, once the substance contained inside the vessel has been finished, the container must be thrown away.

SUMMARY OF THE INVENTION

The object of the present invention is to provide a container which is an improvement on the prior art.

A further object of the invention is to provide a container which is more environmentally compatible than those according to the prior art.

This and other objects are achieved by means of a container produced according to the technical teachings of the claims appended hereto.

Advantageously, the container according to the present invention is refillable.

BRIEF DESCRIPTION OF THE FIGURES

Further features and advantages of the innovation will become clearer in the description of a preferred but not exclusive embodiment of the container, illustrated—by way of a non-limiting example—in the drawings annexed hereto, in which.

DETAILED DESCRIPTION OF THE INVENTION

With reference to the figures stated, reference number 1 is used to denote, as a whole, a container for a cosmetic product.

The product or substance present in the container can be of any kind, preferably of the cosmetic kind, such as a cream, a make-up powder (e.g. face powder) etc, hair gel, anti-wrinkle cream, moisturiser etc.

In this document, the term 'cosmetic product' may also refer to a product with medical properties.

Figure 1:
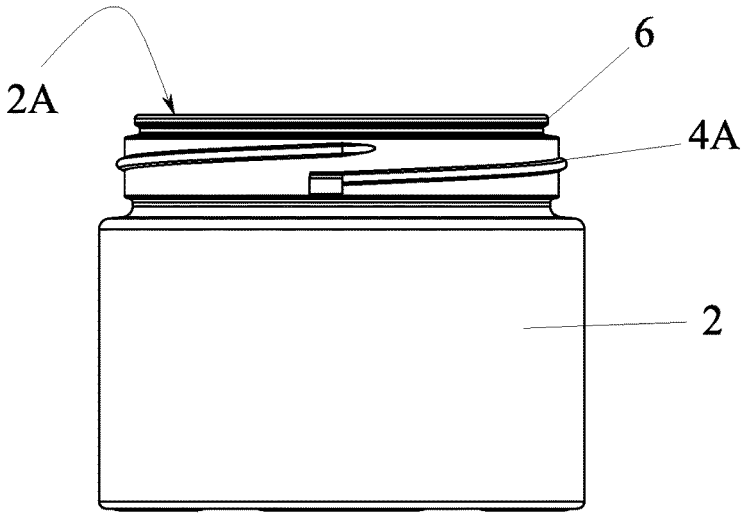
FIG. 1 is a side view of a pot of the container according to the present invention.
Figure 2:
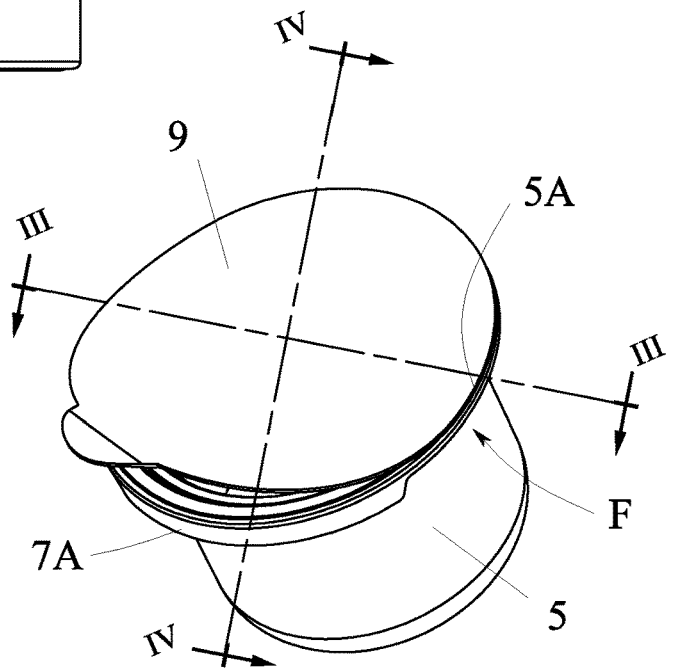
FIG. 2 is a perspective view of a vessel of the container according to the present invention: when in use, the vessel is located inside the pot.
Figure 3:
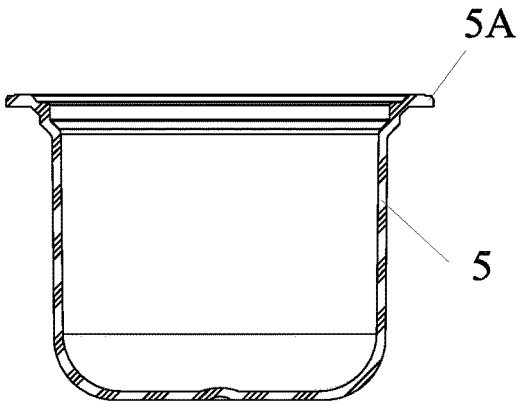
FIG. 3 is a simplified sectional view, taken along line III-III in FIG. 2.
Figure 4:
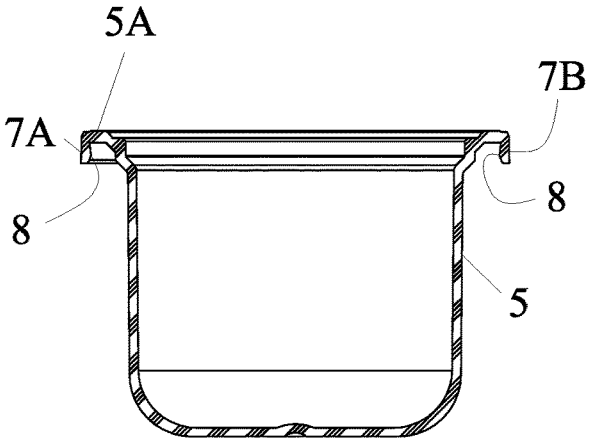
FIG. 4 is a simplified sectional view taken along line IV-IV in FIG. 2.
Figure 5:
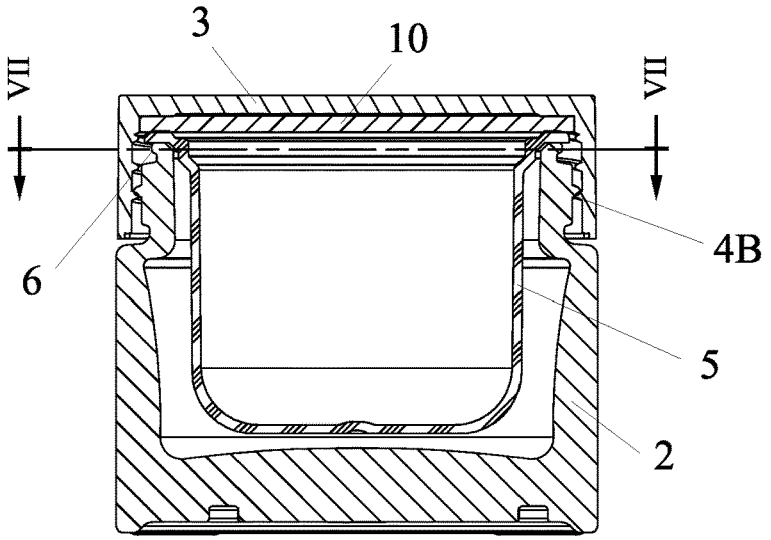
FIG. 5 is a simplified sectional view taken along line V-V in FIG. 7.
Figure 6:
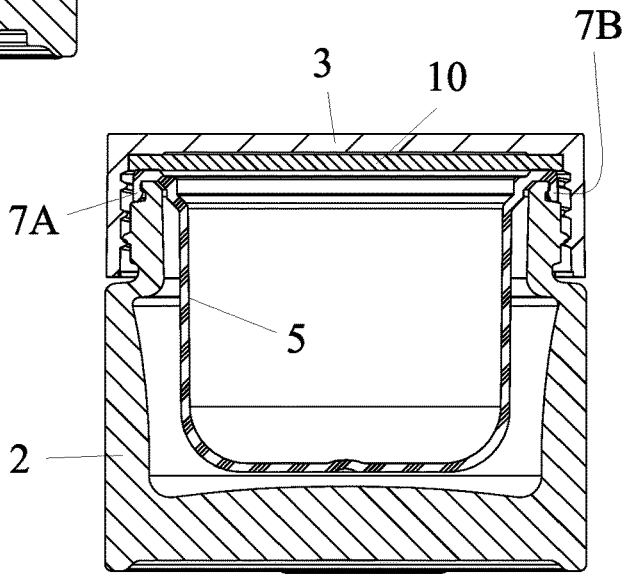
FIG. 6 is a simplified sectional view taken along line VI-VI in FIG. 7.

The container 1 comprises a pot 2 and a lid 3 (FIG. 5).

The pot 2 is preferably made of glass but, obviously, may also be made of plastic (for example, by processes such as extrusion blow-moulding, injection-moulding, and/or injection stretch blow-moulding).

Obviously, the pot 2 can be decorated or printed on either the internal or external surfaces or both thereof, using conventional techniques.

Between the pot 2 and the lid 3 there are mutual coupling means 4A, 4B envisaged.

For example, these means can feature a thread 4A made on the pot 2 and configured to engage with a counter-thread 4B made on the lid 3. But another kind of coupling is also possible, for example simply a pressure-fit coupling.

A disc 10 can be envisaged between the lid 3 and the pot 2, as a seal, which may be made of paper or HDPE, LDPE, AL, PP, for example. The disc 10 can rest on a flange 5A of the vessel 5, which will be described further on in this document.

As already mentioned, the container 1 includes a vessel 5 which is positioned at least partially inside the pot 2. More specifically, the majority of the vessel is placed inside a cavity in the pot 2.

In an embodiment not shown in this document, the vessel 5 can feature more than one compartment therewithin. For example, a diametric partition can be envisaged which divides the cavity in the container into two mutually insulated compartments.

It is also possible to provide more than one partition, for example, two arranged in a crosswise fashion or three arranged along the diagonals of a hexagon, or the partitions can be radial and arranged for example in a star shape, in order to form a containment compartment which is between two neighbouring radial partitions and isolated from the others.

The container 5 is made of plastic material which is formed, for example, by injection moulding. Suitable plastic materials may comprise one or more of the following: PP, HDPE, LDPE, PET, PETG.

The pot 2 comprises, at a mouth 2A thereof, at least one tooth 6, 6A, 6B projecting laterally (and perimetrically) with respect to the said mouth 2A.

In the embodiment shown in the figures on pages 1 and 2 of the drawings, the tooth is a continuous half-ring which externally surrounds the wall of the pot 2 that delimits the mouth 2A. The said tooth is neighbouring to a free edge of the pot 2.

The tooth is advantageously closer to the free edge than the aforementioned means 4A for coupling with the lid 3.

The vessel 5 comprises a flange 5A which is resting on a free end of the mouth 2A of the container. More specifically, the flange 5A is resting on the free end of the wall of the pot 2 that delimits the mouth 2A.

Advantageously, in a plan view, the flange can protrude slightly with respect to the perimeter of the mouth 2A. The protrusion of the flange 5A with respect to the wall that delimits the mouth 2A is clearly highlighted in FIG. 5.

According to the invention, at least one skirt 7A, 7B extends from the flange 5A in an essentially perpendicular direction to the said flange, the said skirt being endowed with at least one counter tooth 8 which engages, in an undercut manner, with the said at least one tooth 6.

The skirt 7A, 7B is interrupted in at least one portion of the perimeter in order to expose at least part of the flange 5A (which can protrude perimetrically from the free edge of the wall that delimits the mouth of the container).

In this way, a user is facilitated in the removal of the vessel 5 from the pot 2.

Using their fingers (for example by inserting them into the area shown by the arrow F, when the vessel 5 is attached to the pot 2), the user can hook the exposed part of the flange 5A and pull out the vessel 5, separating the latter from the pot 2.

The separation is completed by disengaging the tooth 6 from the counter-tooth/teeth 8.

In this way it is possible to dispose of the pot and the vessel separately in sorted waste collection systems (for example, separating from the plastic the glass).

Alternatively, it is possible to obtain a new internal vessel 5 (containing the product) and position the said vessel inside the pot 2, thereby reusing the container 1.

Advantageously, the vessel 5 can comprise a film 9 which keeps the said vessel hermetically sealed and is removable upon first use.

The film 9 is also useful for isolating the contents of a refill vessel 5 in the event of use thereof.

Obviously, as an alternative to the film 9, it is possible to envisage any other removable sealing means, such as a rigid hermetic cap, etc.

Figure 7:
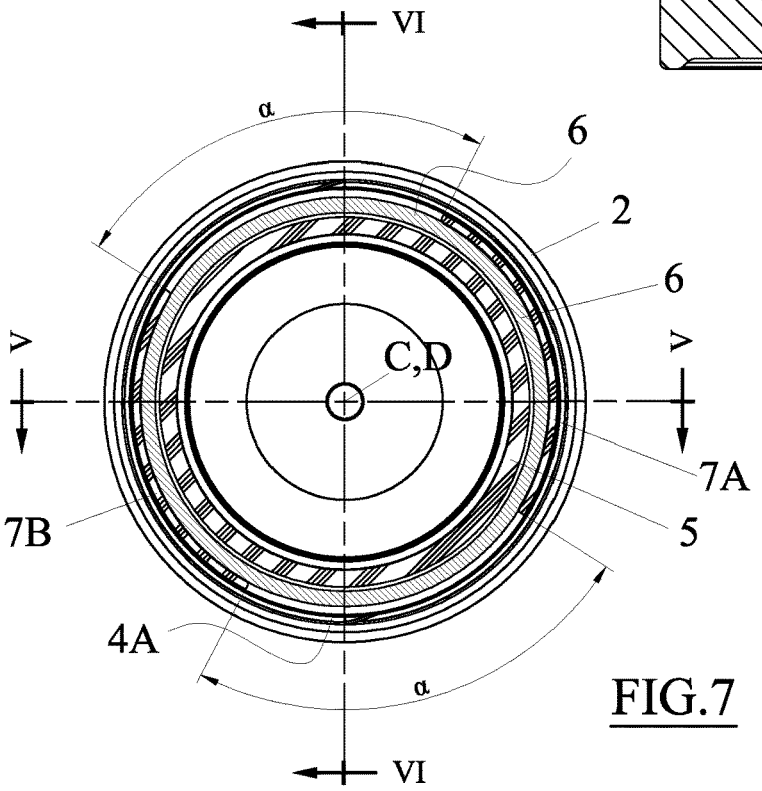
FIG. 7 is a simplified sectional view taken along line VII-VII in FIG. 5.
Figure 8:
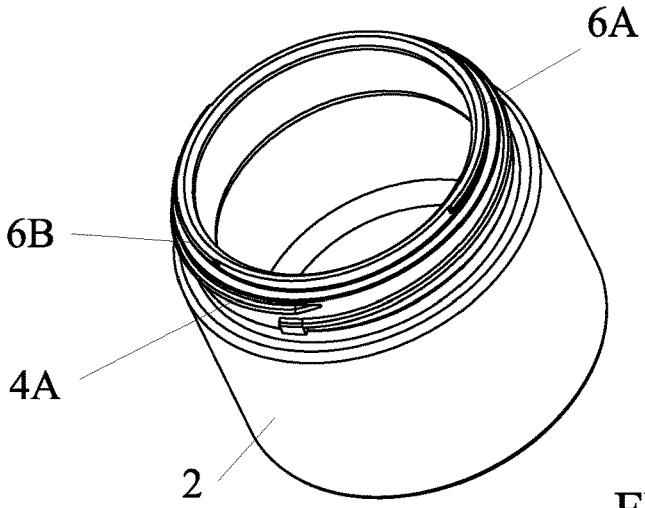
FIG. 8 is a perspective view of a further embodiment of the pot in FIG. 1.
Figure 9:
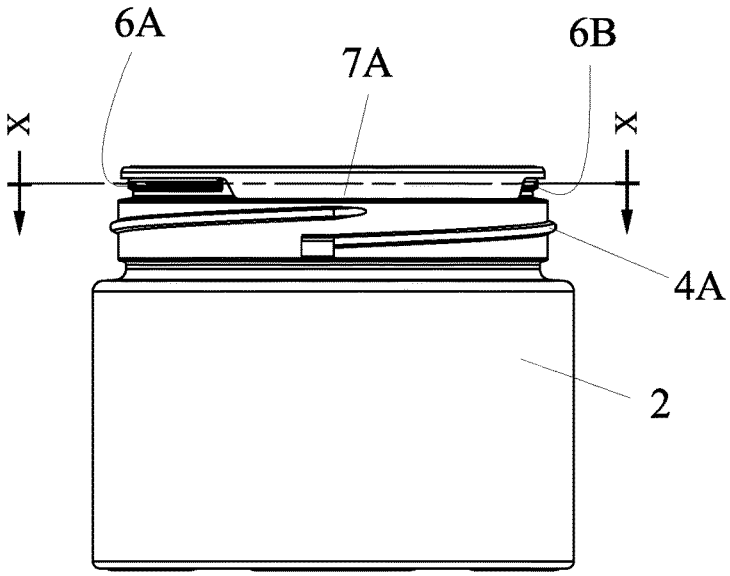
FIG. 9 is a side view of the pot in FIG. 8 coupled to the vessel in FIG. 2.
Figure 10:
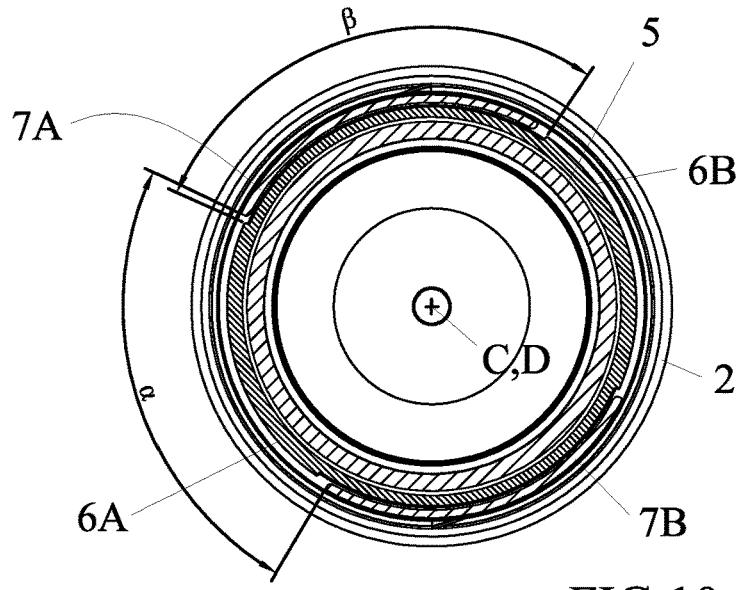
FIG. 10 is a simplified sectional view taken along line X-X in FIG. 9.

As is visible in FIG. 7, the skirt 7A, 7B can be interrupted in more than one position along the perimeter thereof, for example in at least two portions, in order to determine at least a first wall 7A and a second wall 7B which are spaced apart in an angular fashion along the perimeter of the said skirt.

Obviously, a different number of 'interruptions' in the skirt can also be envisaged, such as three (thereby resulting in the formation of three walls), four interruptions (resulting in four walls) and so forth.

Usefully, the angular distance between one wall of the skirt and the wall there beside is large enough to be able to comfortably insert either a thumb (to push the vessel away from the pot) or three fingers (to pull the vessel away from the pot).

Advantageously, as can be seen in FIG. 7, the first and second walls 7A, 7B are symmetrical with respect to the centre C of the vessel and spaced apart in angular fashion wherein a first angle $\alpha$ is of between 30° and 170°, preferably between 80 and 110°, preferably of 85°.

This configuration can be effective in the event that there is an even number of interruptions in the skirt.

In the event that there is an odd number of interruptions in the skirt 6, the walls (for example three, for three interruptions) will preferably be arranged in an organised manner, for example with the centre thereof at the vertices of an equilateral triangle, or of a pentagon (in the case of five walls and 5 interruptions) and so forth.

According to one aspect of the invention which is specifically suitable for a glass pot 2, the tooth 6 extends along the entire perimeter of the mouth 2A of the pot 2.

Alternatively, as is visible in the figures on page 3 of the drawings, the tooth 6 includes at least a first peripheral section 6A and a second peripheral section 6B which are mutually spaced apart. This configuration is more expensive if applied to a glass pot 2 but is easily achievable in the case of a plastic pot 2.

In this case, the internal vessel 5 can still be made to pressure-fit onto the tooth, but more advantageously the said vessel is fastened to the pot by rotation, through the creation of a bayonet-like coupling.

For this purpose, the first perimetral section 6A and the second 6B of the tooth 6 can be symmetrical with respect to the centre D of the pot 2.

The said sections can be spaced apart in an angular fashion by a second angle ß which is greater than the first angle $\alpha$ (see FIG. 7).

The greater size of the angle ß with respect to the angle $\alpha$ allows the impediment—free extraction of the vessel following a relative rotation between the pot 2 and the vessel.

Basically, the coupling between the vessel 5 and the pot 2 may be, in fact, a bayonet coupling.

It goes without saying that if the vessel features a skirt 7A, 7B with more than two interruptions, the tooth 6, 6A, 6B can also be interrupted at several points, precisely to facilitate the release brought about by the aforementioned rotation.

Various embodiments of the innovation have been disclosed herein, but further embodiments may also be conceived using the same innovative concept.

The invention claimed is:

1. A container (1) of a cosmetic product, comprising a pot (2) and a lid (3), mutual coupling means (4A, 4B) being provided between the pot (2) and the lid (3), and a vessel (5) positioned at least partially inside the pot (2), the vessel being made of plastic material, the pot (2) comprising, at its mouth (2A), at least one tooth (6, 6A, 6B) projecting laterally with respect to said mouth (2A), the vessel (5) comprising a flange (5A) resting on a free end of the mouth (2A) of the pot, from said flange (5A) it extends, substantially perpendicular to the flange, at least one skirt (7A, 7B) equipped with at least one counter-tooth (8) which engages in undercut manner with said at least one tooth (6), said skirt (7A, 7B) being perimetrically interrupted in at least one portion, to expose at least a perimetral part of the flange (5A), the skirt (7A, 7B) being perimetrically interrupted in at least two portions, so as to define at least a first (7A) and a second wall (7B) angularly spaced along the perimeter of the skirt itself, the tooth (6) comprising at least a first (6A) and a second peripheral portion (6B), spaced apart from each other, wherein the first and second walls (7A, 7B) are symmetrical with respect to a center (C) of the vessel and angularly spaced of a first angle ($\alpha$), wherein the first (6A) and the second peripheral portion (6B) of the tooth (6) are symmetrical with respect to a center (D) of the pot (2) and angularly spaced by a second angle ($\beta$) that is greater than the first angle ($\alpha$), wherein the vessel (5) is adapted to be rotatably fastened to the pot (2) by a bayonet coupling, and wherein the first and second walls (7A, 7B) fit in a space between the first (6A) and the second peripheral portion (6B) of the tooth (6) and are adapted to engage corresponding tooth portions (6A, 6B) when the vessel (5) is rotated.

2. The container according to claim 1, wherein the first angle ($\alpha$) is comprised between 3° and 170°.

3. The container according to claim 2, wherein the vessel (5) comprises a film (9) removable for a first use, which seals the vessel itself.

4. The container according to claim 1, in which a disc (10) is provided between the lid (3) and the flange (5A) of the vessel with a sealing function.

5. The container according to claim 1 wherein the pot (2) is made of glass.

* * * * *